US011498793B2

(12) United States Patent
Furumido et al.

(10) Patent No.: US 11,498,793 B2
(45) Date of Patent: Nov. 15, 2022

(54) MEDIUM TRANSPORT DEVICE, POST-PROCESSING DEVICE, AND RECORDING APPARATUS

(71) Applicant: SEIKO EPSON CORPORATION, Tokyo (JP)

(72) Inventors: Tsuyoshi Furumido, Shiojiri (JP); Atsushi Nakazawa, Matsumoto (JP); Akinobu Nakahata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 6 days.

(21) Appl. No.: 17/063,321

(22) Filed: Oct. 5, 2020

(65) Prior Publication Data

US 2021/0101770 A1 Apr. 8, 2021

(30) Foreign Application Priority Data

Oct. 7, 2019 (JP) ..... JP2019-184341

(51) Int. Cl.

| | |
|---|---|
| ***B65H 29/20*** | (2006.01) |
| ***B65H 31/34*** | (2006.01) |
| ***B41J 11/00*** | (2006.01) |
| ***B65H 37/00*** | (2006.01) |
| ***B65H 29/52*** | (2006.01) |

(52) U.S. Cl.

CPC ..... *B65H 31/34* (2013.01); *B41J 11/0015* (2013.01); *B41J 11/0045* (2013.01); *B65H 29/52* (2013.01); *B65H 37/00* (2013.01)

(58) Field of Classification Search

CPC ..... B65H 2301/363; B65H 2408/114; B65H 2408/1142; B65H 2404/65; B65H 31/34; B65H 29/20; B65H 29/22; B65H 29/38; B65H 29/40; B65H 29/52

USPC ..... 270/58.12, 58.17

See application file for complete search history.

(56) References Cited

U.S. PATENT DOCUMENTS

| | | | | |
|---|---|---|---|---|
| 4,019,730 A * | 4/1977 | Staudinger | B65H 29/22 | 271/181 |
| 7,874,553 B2 * | 1/2011 | Kushida | B65H 31/02 | 271/220 |
| 8,505,904 B2 * | 8/2013 | Min | B65H 29/26 | 270/58.11 |

(Continued)

FOREIGN PATENT DOCUMENTS

| | | |
|---|---|---|
| CN | 106241472 | 12/2016 |
| JP | 08-12173 | 1/1996 |

(Continued)

*Primary Examiner* — Leslie A Nicholson, III

(74) *Attorney, Agent, or Firm* — Workman Nydegger

(57) ABSTRACT

A medium transport device includes a lower guide member, a processing tray, a feeding section, and a notch. The lower guide member supports a medium transported and guides the medium toward the processing tray. The processing tray includes an alignment member, and a plurality of media are stacked in the processing tray. The feeding section includes a paddle member having a rotation center between the processing tray and the lower guide member such that a rotation locus of a distal end intersects the lower guide member, and the feeding section is configured to feed the medium toward the alignment member. The lower guide member has a notch, and an upstream end of the notch in the transport direction is formed at a position inside the rotation locus in the lower guide member.

18 Claims, 8 Drawing Sheets

(56) References Cited

U.S. PATENT DOCUMENTS

| | | | | |
|---|---|---|---|---|
| 9,656,834 | B2 * | 5/2017 | Moriwaki | B65H 29/22 |
| 9,718,635 | B2 * | 8/2017 | Sato | B65H 31/34 |
| 9,994,408 | B2 * | 6/2018 | Terao | B65H 29/22 |
| 10,882,710 | B2 * | 1/2021 | Taki | B65H 31/3018 |
| 11,142,423 | B2 * | 10/2021 | Kotani | B65H 31/24 |
| 2016/0355363 | A1 | 12/2016 | Terao | |
| 2017/0137253 | A1 | 5/2017 | Sato | |
| 2018/0181050 | A1 * | 6/2018 | Kawaguchi | B65H 31/02 |
| 2018/0257894 | A1 | 9/2018 | Terao | |

FOREIGN PATENT DOCUMENTS

| | | |
|---|---|---|
| JP | 2010-006530 | 1/2010 |
| JP | 2017-095186 | 6/2017 |

* cited by examiner

MEDIUM TRANSPORT DEVICE, POST-PROCESSING DEVICE, AND RECORDING APPARATUS

The present application is based on, and claims priority from JP Application Serial Number 2019-184341, filed Oct. 7, 2019, the disclosure of which is hereby incorporated by reference herein in its entirety.

BACKGROUND

1. Technical Field

The present disclosure relates to a medium transport device that transports a medium, a post-processing device having the medium transport device, and a recording apparatus having the post-processing device.

2. Related Art

There have been known apparatuses having a medium transport device that transports media such as sheets. JP-A-2010-6530 is an example of the related art. The post-processing device disclosed in JP-A-2010-6530 has a configuration in which paper sheets, which are outputted from an output transport path onto a stack tray, are then transported by a rotating paddle.

According to the configuration disclosed in JP-A-2010-6530, which includes a guide member that guides a medium to a stacking section and a feeding member that feeds the medium in the stacking section toward an alignment section, transport of a medium may become unstable due to contact between the guide member and the rotating feeding member. In addition, when the feeding member is disengaged and released from the guide member, the feeding member irregularly vibrates. When such a feeding member comes into contact with the medium, the vibration is propagated to the medium, which may cause unstable feeding of the medium toward the alignment section.

SUMMARY

In order to solve the above problem, a medium transport device according to the present disclosure includes: a guide member that supports and guides a medium transported in a transport direction; a stacking section having an alignment section that aligns upstream end in the transport direction of a medium bundle composed of a plurality of media supported and guided by the guide member, the stacking section being configured so that a plurality of the media are stacked thereon; a feeding section having a feeding member formed of an elastic material, and the feeding section being configured to rotate to thereby feed the medium on the stacking section toward the alignment section; and a notch formed in the guide member at a region where the feeding member is disposed in a width direction of the guide member which intersects the transport direction, the notch being cut out toward upstream in the transport direction, wherein a rotation center of the feeding section is disposed at a position between the stacking section and the guide member such that a rotation locus of a distal end of the feeding member intersects the guide member when viewed in the width direction, and an upstream end of the notch in the transport direction is formed inside the rotation locus.

DESCRIPTION OF EXEMPLARY EMBODIMENTS

Figure 1:
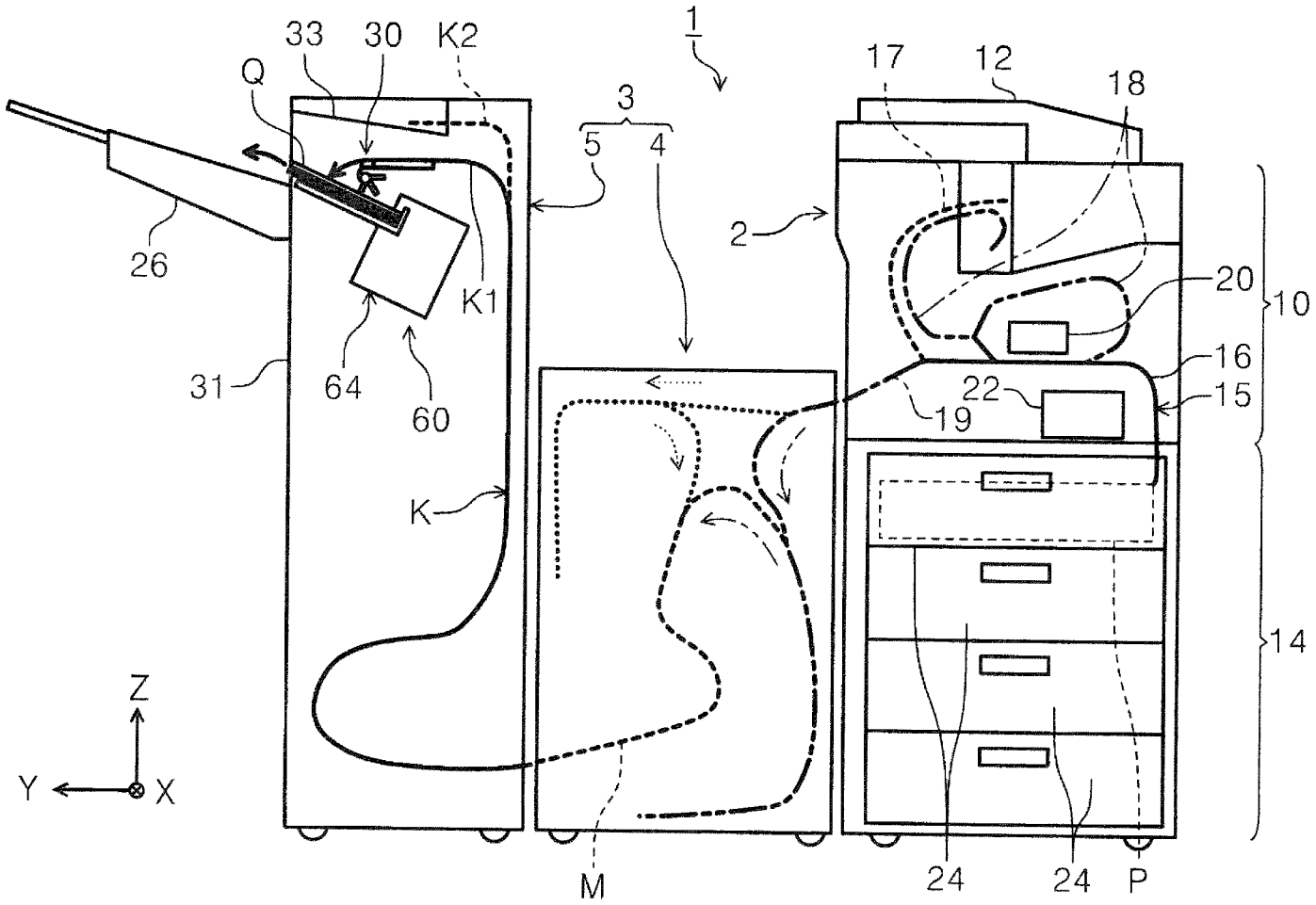
FIG. 1 is a schematic diagram of a recording system.

The present disclosure will now be schematically described. In order to solve the above problem, according to a first form of the present disclosure, a medium transport device includes: a guide member that supports and guides a medium transported in a transport direction; a stacking section having an alignment section that aligns upstream end in the transport direction of a medium bundle composed of a plurality of media supported and guided by the guide member, the stacking section being configured so that a plurality of the media are stacked thereon; a feeding section having a feeding member formed of an elastic material, and the feeding section being configured to rotate to thereby feed the medium on the stacking section toward the alignment section; and a notch formed in the guide member at a region where the feeding member is disposed in a width direction of the guide member which intersects the transport direction, the notch being cut out toward upstream in the transport direction, wherein a rotation center of the feeding section is disposed at a position between the stacking section and the guide member such that a rotation locus of a distal end of the feeding member intersects the guide member when viewed in the width direction, and an upstream end of the notch in the transport direction is formed inside the rotation locus.

With this configuration, the guide member supports the medium transported in the transport direction, and guides the medium toward a second end of the stacking section in the transport direction. The stacking section accommodates the media that have been guided by the guide member so that the media are stacked as the medium bundle. The feeding member rotates to thereby feed the medium in the stacking section toward the alignment section. The alignment section aligns the upstream end of the medium bundle in the transport direction. Since a portion of the guide member other than the notch supports the medium while the medium is transported in the transport direction, the medium can be guided downstream in the transport direction in a stable manner. When the distal end comes into contact with the guide member as the feeding member rotates, a portion of the guide member where the notch is formed allows the distal end to enter and pass through the notch in the rotation direction. Accordingly, the distal end and the guide member are disengaged from each other at an early stage in the rotation. As a result, since the vibration of the feeding member caused by contact between the feeding member and the guide member is reduced, the medium can be fed to the alignment section in a stable manner. That is, in a configuration in which the feeding member interferes a guide path along which the medium is guided by the guide member, the medium can be stably transported to the stacking section and stably fed to the alignment section.

In the medium transport device according to a second form of the present disclosure, in the above first form, a cleaning unit that cleans the feeding member by contacting the feeding member is provided on the guide member at a position upstream from the notch in the transport direction on a surface opposite to that supporting the medium.

With this configuration, when the feeding member rotates, a portion of the feeding member including the distal end comes into contact with the cleaning unit. The portion of the feeding member is cleaned by the cleaning unit. Accordingly, even if dirt is attached on part of the feeding member during previous feeding operation for the medium, the dirt is cleaned by the cleaning unit so that the medium bundle is prevented from getting dirty in the next feeding operation.

The medium transport device according to a third form of the present disclosure, in the above first form or second form, a first distance from the rotation center of the feeding member to the notch is smaller than a second distance from the rotation center to the stacking section when the feeding member is viewed in the width direction.

With this configuration, the stacking section and the guide member can be disposed close to each other compared with a configuration in which the first distance is larger than the second distance. Accordingly, the medium transport device can be reduced in size.

The medium transport device according to a fourth form of the present disclosure, in any one of the above first to third forms, a transport member that transports the medium is rotatably provided on a side wall of the notch of the guide member on one side in the width direction.

With this configuration, the transport member is rotatably mounted on the side wall on a first end of the notch in the width direction. As the transport member rotates, frictional force applied to the medium decreases, which facilitates transport of the medium. In addition, since the side wall is adjacent to a notched space, an operation of mounting the transport member to the side wall can be easy. That is, it is possible to facilitate transport of the medium, and facilitate operation of mounting the transport member to the side wall.

The medium transport device according to a fifth form of the present disclosure, in any one of the above first to fourth forms, the feeding member includes a shaft rotatable about an axial direction in the width direction, and at least one vane extending outward from the shaft, and the vane is positioned at a retracted position on an opposite side of the guide member to the medium when the medium is guided by the guide member.

With this configuration, when the medium is guided by the guide member, the vane is at the retracted position on a side of the guide member to the medium. Accordingly, while the feeding member is stationary, the vane does not protrude from the guide member into the transport path of the medium. Therefore, the vane and the medium can be prevented from being in contact with each other. Furthermore, when the retracted position is set as a position spaced from the guide member, the vane does not contact with the guide member. Since the vane is not exposed to a load, the possibility of deformation of the vane can be reduced. That is, it is possible to prevent the vane from interfering with the transport of the medium, and prevent the vane from deforming.

The medium transport device according to a sixth form of the present disclosure, in the fifth form, the feeding member includes a plurality of vanes provided at an interval in a rotation direction, and, when a first vane among the plurality of vanes is located at the retracted position, another vane is in contact with the medium bundle in the stacking section.

With this configuration, since the first vane is at the retracted position, it is possible to prevent the first vane from interfering with the transport of the medium. Further, since another vane is in contact with the medium bundle in the stacking section when the first vane is at the retracted position, it is possible to prevent the medium bundle in the stacking section from being displaced. That is, it is possible to prevent the vane from interfering with the transport of the medium, and prevent the medium bundle from being displaced.

According to a seventh form of the present disclosure, a post-processing device includes: the medium transport device according to any one of the first to sixth forms; and a processing unit configured to perform post-processing to a medium transported by the medium transport device.

With this configuration, in the post-processing device, the advantageous effect which is the same as that of the medium transport device according to any one of the first to sixth forms can be achieved.

According to an eighth form of the present disclosure, a recording apparatus includes: a recording unit configured to record information on a medium; and the post-processing device according to the seventh form, the post-processing device being configured to perform post-processing to the medium on which information is recorded by the recording unit.

With this configuration, in the recording apparatus, the advantageous effect which is the same as that of the post-processing device according to the seventh form can be achieved.

Embodiment

With reference to the drawings, an embodiment of a medium transport device, a post-processing device, and a recording apparatus according to the present disclosure will now be described in detail. In the X-Y-Z coordinate system indicated in the drawings, the X axis direction is an apparatus depth direction, the Y axis direction is an apparatus width direction, and the Z axis direction is an apparatus height direction. Further, in order to distinguish between the back side and the front side in the apparatus depth direction, the back side is referred to as +X side, and the front side is referred to as −X side. In order to distinguish between the left side and the right side in the apparatus width direction, the left side is referred to as +Y side, and the right side is referred to as −Y side. In order to distinguish between the upper side and the lower side in the apparatus height direction, the upper is referred to as +Z side, and the lower side is referred to as −Z side.

Outline of Recording System

FIG. 1 shows a recording system 1 as an example of a recording apparatus. FIG. 1 is a front view of the recording system 1. The recording system 1 includes a recording unit 2, and a post-processing unit 3 as an example of a post-processing device, disposed in this order from the right side to the left side in FIG. 1. In the recording system 1, the recording unit 2 and the post-processing unit 3 are mechanically and electrically coupled to each other, and a medium P is transported from the recording unit 2 to the post-processing unit 3.

An operator (not shown) can perform various operation from a position on the −X side, which is the front side of the recording system 1. The recording system 1 includes an operation panel (not shown) operated by the operator. The operation panel is configured such that various settings for the recording unit 2 and the post-processing unit 3 can be set therewith. For example, the operation panel can be disposed in the recording unit 2. In addition, the recording system 1 is configured to perform post-processing to the medium P on which information has been recorded by a printer unit 10, described later. In the recording system 1, the same advantageous effect as that of the post-processing unit 3 described later can be obtained.

Recording Unit

The recording unit 2 records various information on the transported medium P. The medium P may be, for example, a sheet-shaped paper sheet. Various information to be recorded on the medium P includes character information and image information. Further, the recording unit 2 includes the printer unit 10, a scanner unit 12, and a cassette storage unit 14.

The printer unit 10 is an example of a recording unit, and includes a line head 20 and a control unit 22. The line head 20 is configured as an ink jet recording head that records various information on the medium P by ejecting ink as an example of liquid onto the medium P. The control unit 22 includes a CPU (central processing unit) and a memory (not shown), and is configured to control transport of the medium P and operation of recording various information on the medium P in the recording unit 2. Further, the control unit 22 can control various operations in the post-processing unit 3 as well as in the recording unit 2.

The scanner unit 12 is configured to read information of a document (not shown). The information of the document that has been read by the scanner unit 12 is stored in the memory in the control unit 22. The cassette storage unit 14 has a plurality of storage cassettes 24 for storing the media P. A transport path 15 in which the medium P is transported is formed in the printer unit 10 and the cassette storage unit 14. The transport path 15 includes, for example, a sheet supply path 16, an output path 17, a reversing path 18, and a feed-out path 19. Further, a transport roller pair (not shown) is provided in each path in the transport path 15. In the transport path 15, the medium P is transported from the storage cassette 24 to a recording section of the line head 20, and further transported from the recording section to the post-processing unit 3.

Post-Processing Unit

The post-processing unit 3 includes an intermediate unit 4 that transports the medium P which has been received from the recording unit 2, and an end unit 5 that applies post-processing collectively to a required number of media P that have been received from the intermediate unit 4. In the present embodiment, the "post-processing" refers to processing applied to the medium P on which information has been recorded by the recording unit 2. In the post-processing unit 3, the same advantageous effect as that of the end unit 5 described later can be obtained.

Intermediate Unit

The intermediate unit 4 is a unit that receives the medium P from the recording unit 2 and transports it to the end unit 5. A transport path M through which the medium P received from the recording unit 2 is transported is formed in the intermediate unit 4. A plurality of transport roller pairs (not shown) are provided in the transport path M. Further, the transport path M is configured such that the medium P is switched back in either one of the two routes. Alternatively, the intermediate unit 4 may be removed so that the medium P is directly transported to the end unit 5 from the recording unit 2.

End Unit

The end unit 5 includes a medium transport unit 30 as the medium transport device, and a processing unit 60 that applies post-processing to the medium P that has been transported by the medium transport unit 30. Further, the end unit 5 includes a housing 31 as an apparatus main body. The housing 31 includes an upper tray 33, and an output tray 26. The upper tray 33 receives the medium P that is not processed by the processing unit 60. The output tray 26 receives the medium P that has been processed by the processing unit 60.

Figure 2:
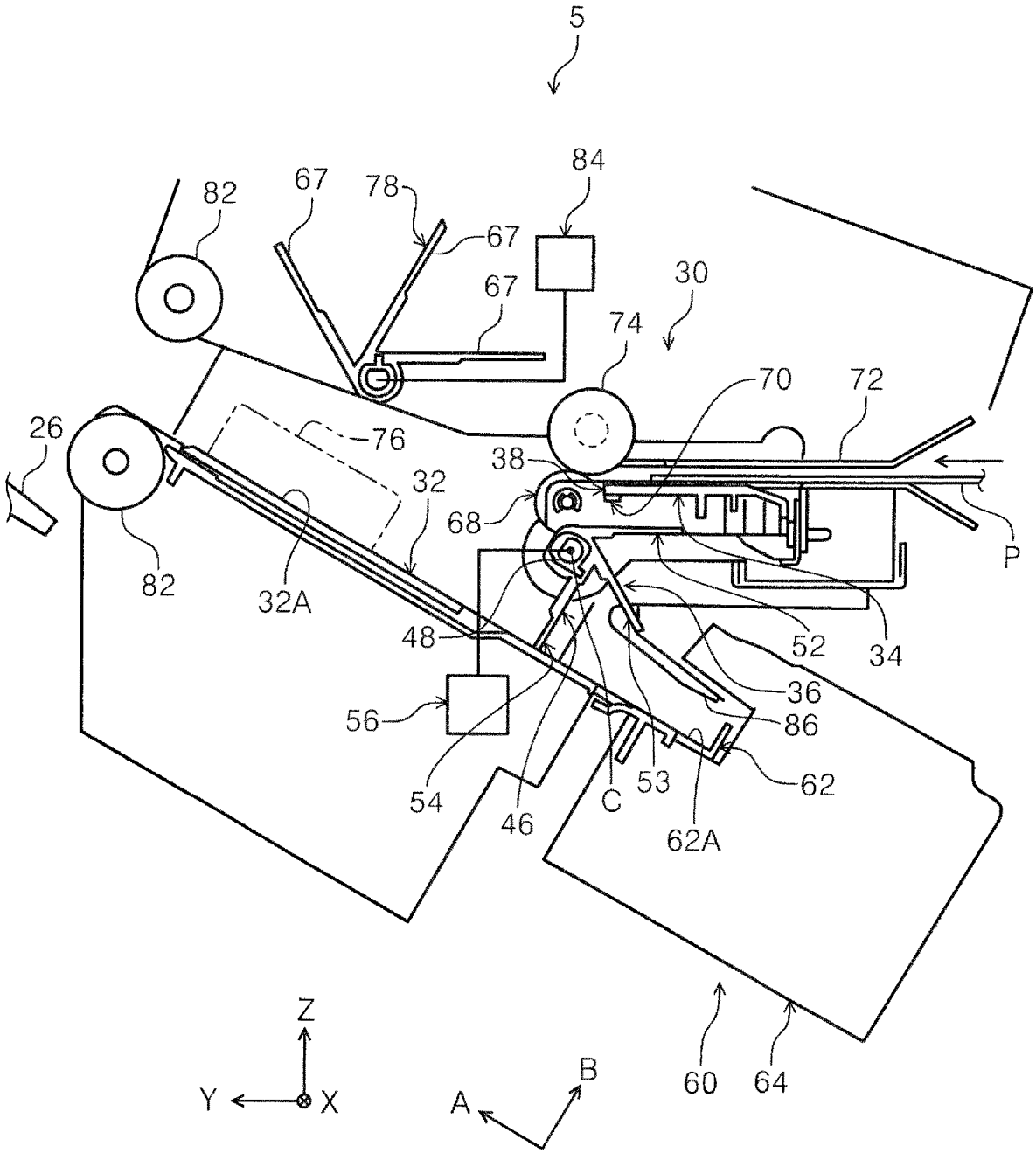
FIG. 2 is a schematic diagram of an internal structure of an end unit.

In the following description, the width direction of a medium bundle Q composed of a plurality of media P is taken as the X axis direction as an example. The Y axis direction corresponding to the width direction of the end unit 5 when the end unit 5 is viewed in the X axis direction. Further, the intersecting direction which intersects the width direction of the medium bundle Q is referred to as an A axis direction (FIG. 2). As an example, the A axis direction is a direction perpendicular to the X axis direction and intersecting the Y axis direction. Further, when viewed in the X axis direction, the A axis direction is inclined such that the +Y side is higher than the −Y side. A direction perpendicular to the X axis direction and the A axis direction is referred to as a B axis direction (FIG. 2).

A transport path K through which the medium P received from the intermediate unit 4 is transported is formed in the end unit 5. The transport path K includes, as an example, a main transport path K1 extending to the processing unit 60, and a sub-transport path K2 extending to the upper tray 33. In FIG. 1, the main transport path K1 is indicated by the solid line, and the sub-transport path K2 is indicated by the dotted line. In the main transport path K1 and the sub-transport path K2, a guide plate and a plurality of roller pairs (not shown) are provided.

Medium Transport Unit

The medium transport unit 30 shown in FIG. 2 includes a processing tray 32, a lower guide member 34, a feeding section 36, and a notch 38. The medium transport unit 30 further includes a transport roller 68, a cleaning member 70, an auxiliary guide 72, an auxiliary roller 74, a side cursor 76, an auxiliary paddle 78, a feed-out roller pair 82, and a driving unit 84.

The auxiliary guide 72, together with the lower guide member 34, forms part of the main transport path K1 (FIG. 1). The auxiliary roller 74 is located downstream from the auxiliary guide 72 in the transport direction of the medium P, and is provided on a side plate (not shown) to be rotatable about the X axis direction. Further, the auxiliary roller 74 cooperates with the transport roller 68, described later, to hold the medium P therebetween and transport the medium P. In addition, the transport direction of the medium P transported by the transport roller 68 is, for example, the Y axis direction. The side cursor 76 is movable in the X axis direction by a motor (not shown) for aligning both ends of the plurality of media P stacked on the processing tray 32 in the X axis direction.

The auxiliary paddle 78 is provided above the processing tray 32 in the Z axis direction and is rotatable about the X axis direction. Further, the auxiliary paddle 78 is controlled to rotate and stop by the driving unit 84 composed of a motor and a gear (not shown) and the control unit 22 (FIG. 1). As an example, the auxiliary paddle 78 includes three rubber plates 67, which rotate to contact with the medium P to thereby feed the medium P on the processing tray 32 toward a paddle member 46, described later. The feed-out roller pair 82 is provided on the +Y side of the auxiliary paddle 78 and rotatable about the X axis direction. As the feed-out roller pair 82 rotates, the medium bundle Q (FIG. 1) on the processing tray 32 is fed out toward the output tray 26.

Processing Tray

Next, a configuration of the medium transport unit 30 will be described. The processing tray 32 shown in FIG. 2 is an example of a stacking section, which is configured to accommodate the plurality of media P. Specifically, the processing tray 32 is formed in a plate shape having the width direction in the X axis direction. The processing tray 32 extends in the A axis direction and has a thickness in the B axis direction. The +Y end of the processing tray 32 is located on the +Z side than the −Y end of the processing tray 32 is. The width of the processing tray 32 in the X axis direction is larger than the width of the medium P in the X axis direction. The plurality of media P are sequentially placed on an upper surface 32A, which is the +Z side surface of the processing tray 32, and stacked in the B direction to form the medium bundle Q composed of the plurality of media P stacked on the processing tray 32 (FIG. 1).

Lower Guide Member

The lower guide member 34 is an example of a guide member, and is disposed on the +Z side of the -A side end, which is a first end, of the processing tray 32 in the A axis direction. Further, the lower guide member 34 is located on the −Z side of the main transport path K1 (FIG. 1). The lower guide member 34 is configured to support the medium P transported in the Y axis direction, and guide the medium P toward the +A side of the processing tray 32 in the A axis direction, which corresponds to a second end in the Y axis direction.

In the present embodiment, a direction in which the medium P is guided by the lower guide member 34 is the Y direction. In other words, the +A side end of the processing tray 32 is located on the +Y side of the lower guide member 34, and on the opposite side to the processing unit 60 in the Y axis direction. Further, as an example, the +X side portion and the −X side portion of the lower guide member 34 have symmetrical shapes about the center in the X axis direction. Therefore, the description will be given of the +X side portion of the lower guide member 34, and the description of the −X side portion is omitted.

Figure 3:
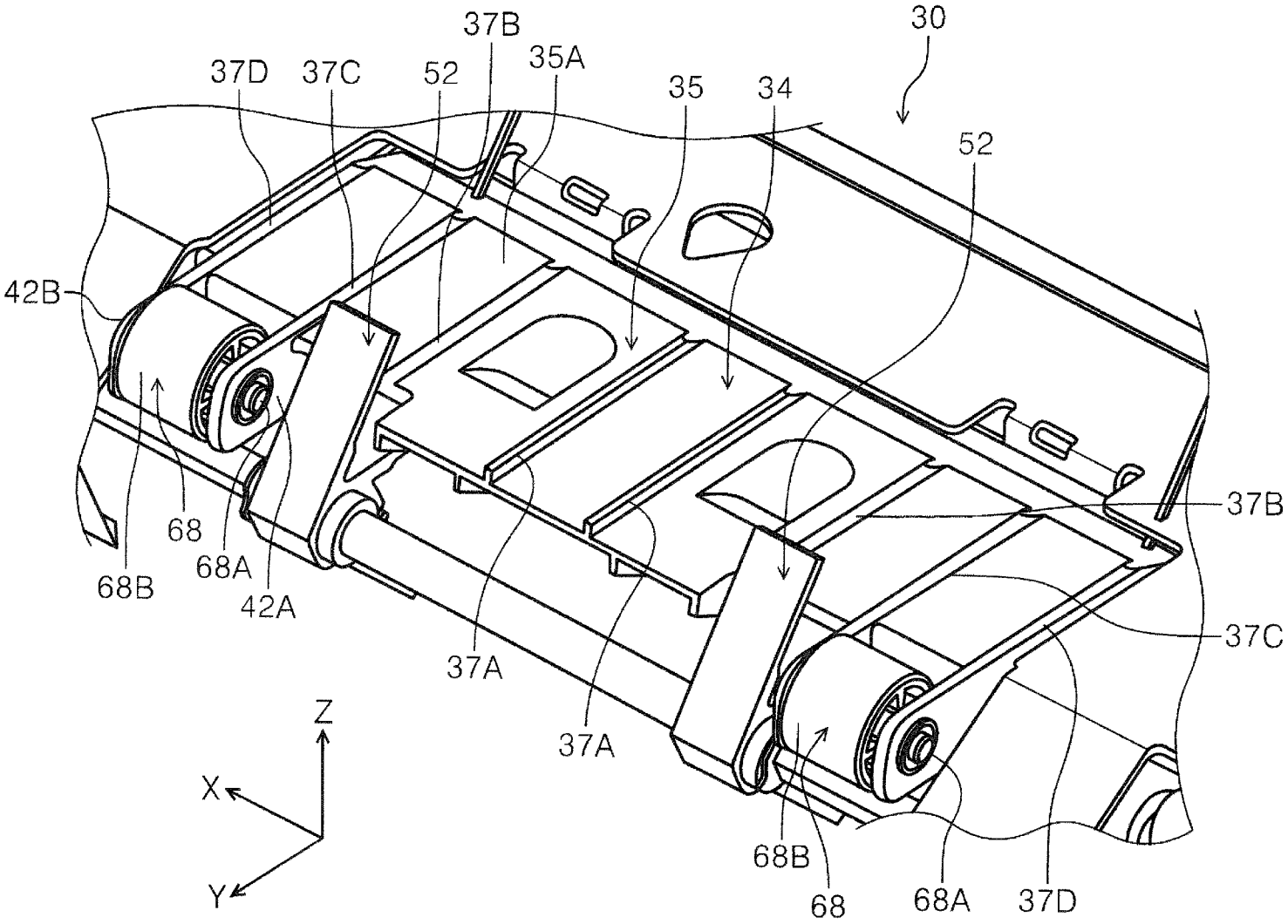
FIG. 3 is a perspective view illustrating part of an internal structure of the end unit.
Figure 4:
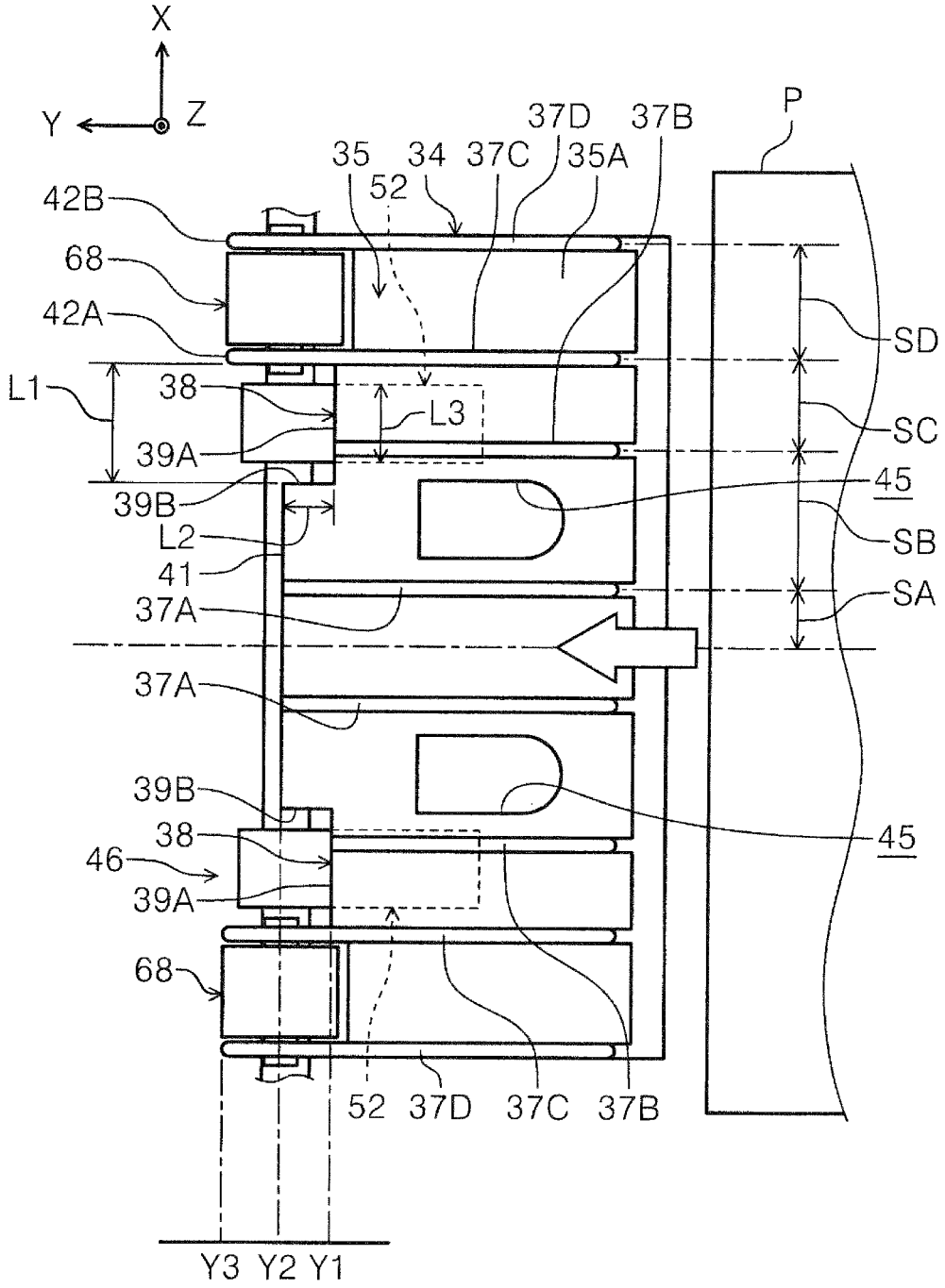
FIG. 4 is a plan view illustrating part of an internal structure of the end unit.

The lower guide member 34 shown in FIG. 3 includes a rectangular plate-shaped base 35 having the thickness direction in the Z axis direction, and is longer in the X axis direction than in the Y axis direction. On the upper surface 35A on the +Z side of the base 35, protrusions 37A, 37B, and 37C extending in the Y axis direction and protruding in the +Z direction are formed. The protrusions 37A, 37B, and 37C are arranged in this order from the center to the +X side in the X axis direction at an interval therebetween. In other words, the base 35 is divided by the protrusions 37A, 37B, and 37C into four regions SA, SB, SC, and SD (FIG. 4). Further, a protrusion 37D, extending in the Y axis direction and protruding in the +Z direction, is formed at an end of the region SD on the upper surface 35A on the side away from the protrusion 37C in the X direction.

The region SA of the lower guide member 34 shown in FIG. 4 constitutes a center portion of the lower guide member 34 in the X direction. The region SB is located on the +X side of the region SA. As an example, the width of the region SB in the X axis direction is larger than the width of the region SA in the X axis direction. The region SB includes a through hole 45 penetrating in the Z axis direction as an example. The region SC is located on the +X side of the region SB, and the region SD is located on the +X side of the region SC. The region SD constitutes an end portion on the +X side of the base 35 in the X axis direction.

An end face 41 extending in the X axis direction when viewed in the Z axis direction is formed straddling the entire region SA and most of the region SB of the lower guide member 34 and constitutes the downstream end thereof in the Y axis direction. The position where the end face 41 is located in the Y axis direction is referred to as a position Y2, which is taken as a reference position. The lower guide member 34 has a notch 38, which is described later.

A side wall 42A and a side wall 42B are formed at positions constituting the downstream end of the region SD of the lower guide member 34 in the Y direction. The side wall 42A, integrated with the protrusion 37C, extends downstream from the base 35 in the +Y direction. Further, the side wall 42A is an example of a +X side wall of the notch 38 in the lower guide member 34 in the X axis direction. The side wall 42A extends on the +Y side of a rotation center C of the paddle member 46 (FIG. 2). The height of the upper end of the side wall 42A in the Z direction is aligned with the height of the upper end of the protrusion 37C in the Z direction. A portion of the side wall 42A on the lower side from the center in the Z direction extends on the lower side from the −Z surface of the base 35. The side wall 42A has a through hole (not shown) penetrating in the X axis direction.

The side wall 42B, integrated with the protrusion 37D, extends in the +Y direction from the base 35. The upper end of the side wall 42B in the Z direction is aligned with the upper end of the protrusion 37D in the Z direction. A portion of the side wall 42B on the lower side from the center in the Z direction extends on the lower side the base 35. The side wall 42B has a through hole (not shown) penetrating in the X axis direction. Thus, the side wall 42B faces the side wall 42A at an interval in the X axis direction. In the Y direction, the position of the +Y end face of the side wall 42A and the position of the +Y end face of the side wall 42B are aligned. This position is referred to as a position Y3. The position Y3 is located, for example, on the +Y side of the position Y2 described above.

Figure 6:
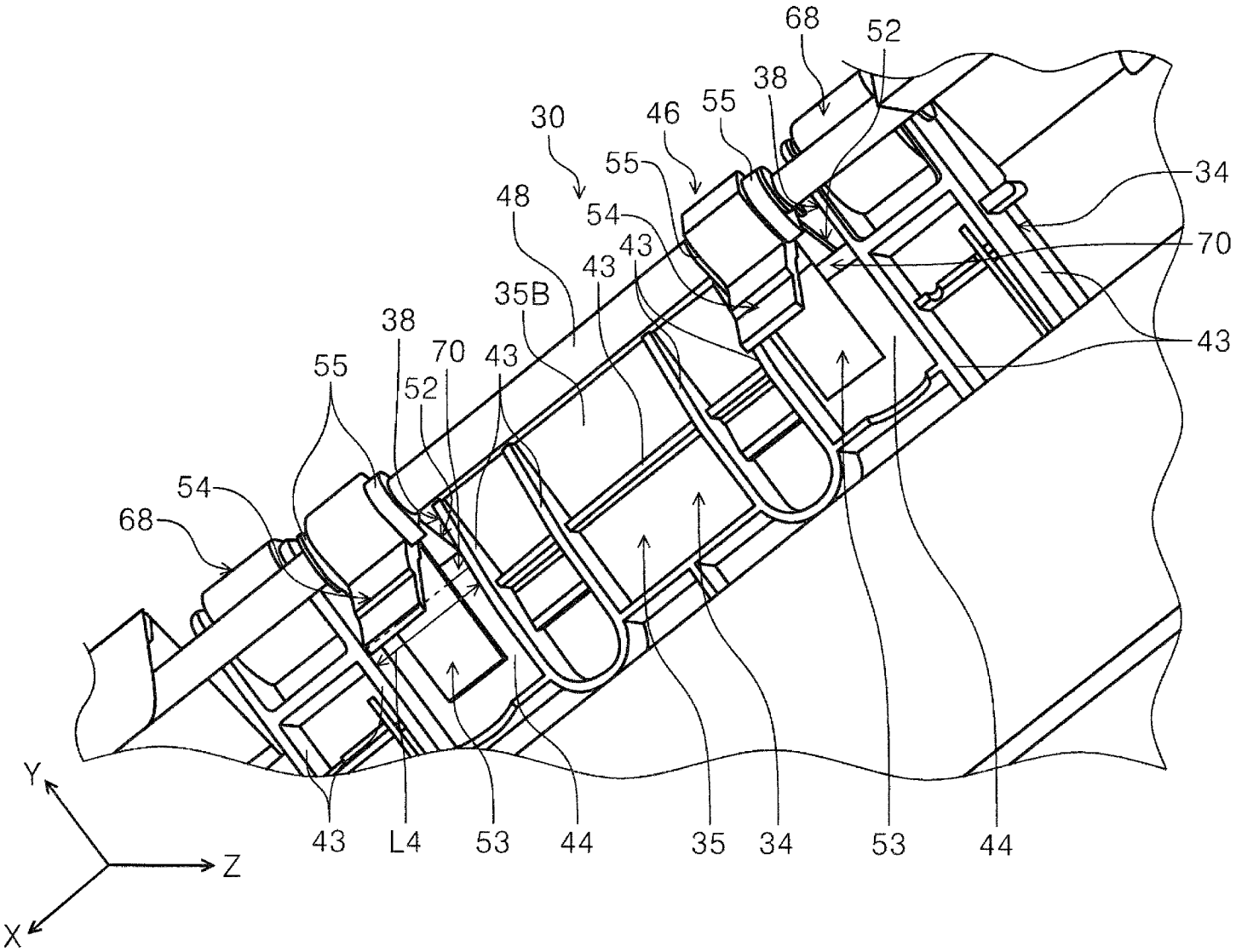
FIG. 6 is a perspective view illustrating part of an internal structure of the end unit.

A plurality of ribs 43 extending on the −Z side are formed on the lower surface 35B on the −Z side of the base 35 shown in FIG. 6. The plurality of ribs 43 are formed to reduce bending of the base 35 when an external force is applied to the base 35. A surface of the lower surface 35B surrounded by some of the plurality of ribs 43, and located on the −Y side of the notch 38 is referred to as a mounted surface 44. The mounted surface 44 is formed, for example, in a rectangular shape having a longer side in the Y direction. Further, a cleaning member 70, described later, is provided on the +Y end of the mounted surface 44 at a portion constituting a part of the peripheral edge of the notch 38. The mounted surface 44 is an example of a surface located upstream relative to the lower guide member 34 in the rotation direction of the paddle member 46, which is described later.

Feeding Section

Figure 5:
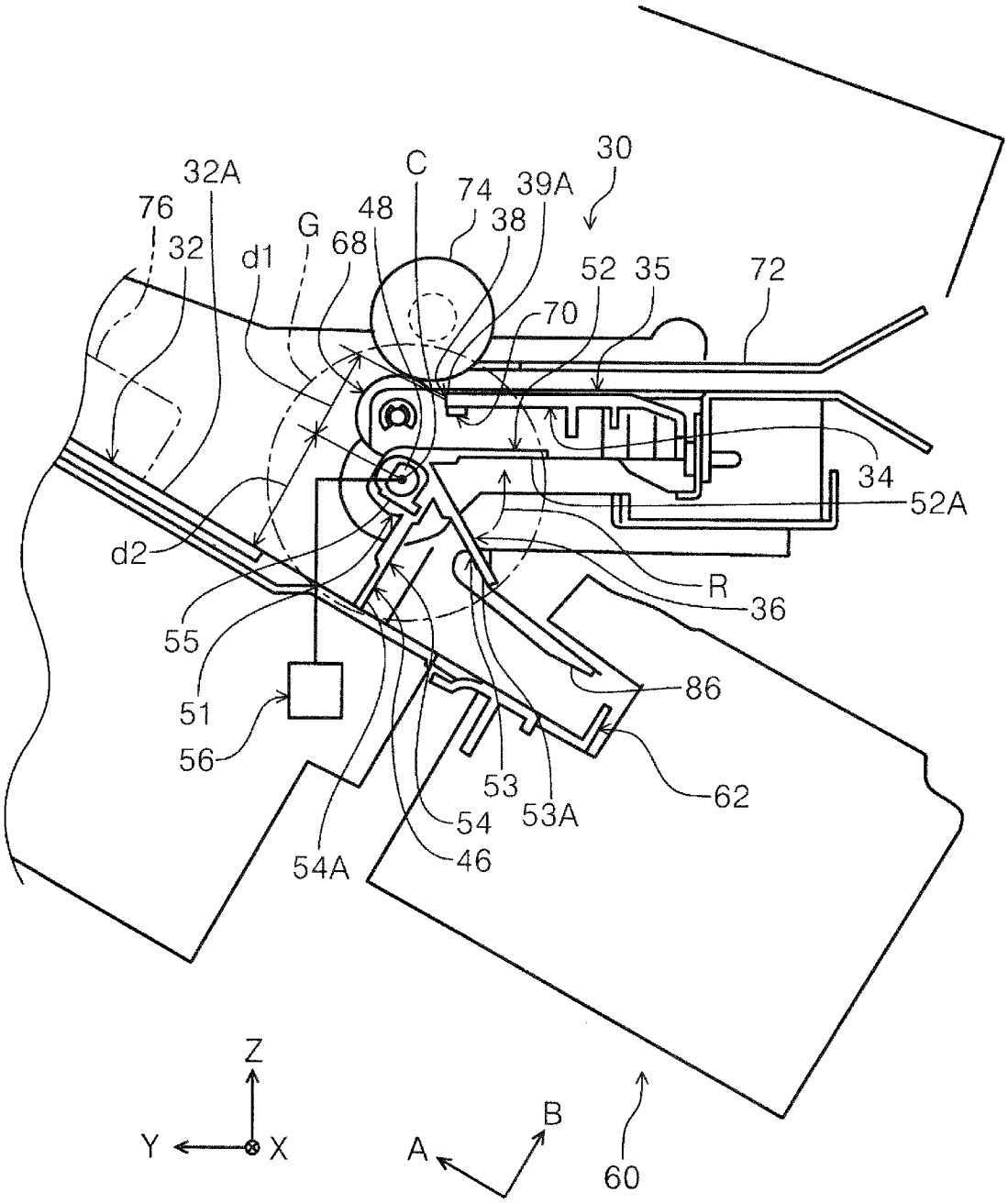
FIG. 5 is a schematic diagram illustrating part of an internal structure of the end unit.

The feeding section 36 shown in FIG. 5 includes the paddle member 46, and a paddle driving unit 56 for rotating the paddle member 46.

The paddle member 46 is an example of a feeding member. Further, the paddle member 46 is rotatable about the rotation center C, which is located between the processing tray 32 and the lower guide member 34 when viewed in the X axis direction. In the following description, the rotation direction of the paddle member 46 indicated by the arrow R is referred to as an R direction. Specifically, the paddle member 46 includes a shaft 48 as an example of a shaft section, a vane 52, a vane 53, and a vane 54 extending outward from the shaft 48 at an interval in the R direction.

Two sets of the vane 52, the vane 53, and the vane 54 are provided at an interval in the X axis direction.

The shaft 48 has an axial direction in the X axis direction. Both ends of the shaft 48 in the X axis direction are rotatably supported by bearings provided on the side plate (not shown). That is, the shaft 48 is rotatable about an axial direction in the X axis direction. In addition, a stopper member 55 is provided on the shaft 48 for preventing the vane 52, the vane 53, and the vane 54 from being detached.

The vane 52, the vane 53, and the vane 54 are each formed in a rectangular plate shape, as an example, and have the thickness in the R direction of the shaft 48. The vane 52, the vane 53, and the vane 54 each have a proximal end 51 integrally formed and mounted on the outer circumferential surface of the shaft 48. Further, as an example, the vane 52, the vane 53, and the vane 54 are the same in size, shape, and material, but differs in extending direction from the outer circumferential surface of the shaft 48. The vane 52, the vane 53, and the vane 54 are made of rubber as an example of an elastic material. In the present embodiment, the "elastic material" refers to a material that deforms when an external force is applied thereto and returns to the substantially original state when the external force is removed.

The vane 52 is an example of a first vane. Further, the vane 52 extends in the tangent direction to a virtual circle (not shown) formed as a locus of the proximal end 51 when the shaft 48 rotates. FIG. 5 illustrates a state in which the vane 52 is located substantially parallel to the base 35 of the lower guide member 34 when the paddle member 46 stops rotating. Such a position of the vane 52 in the R direction of the paddle member 46, in which the vane 52 is retracted from the main transport path K1 (FIG. 1) and stops in a phase that does not interfere with the main transport path K1 is referred to as a "retracted position."

In the present embodiment, when the vane 52 is at the retracted position, the medium P that has been transported in the main transport path K1 is guided to the lower guide member 34. Further, when the vane 52 is at the retracted position, the vane 52 is located on the opposite side of the lower guide member 34 to the medium P, and spaced from the lower guide member 34 on the −Z side. In addition, a distal end of the vane 52 is referred to as a distal end 52A.

The vane 53 is located upstream from the vane 52 in the R direction. Further, when viewed in the X axis direction, the vane 53 extends, as an example, in the tangent direction to the virtual circle described above, forming an angle of 60 degrees between the extending direction of the vane 52 and the vane 53. A distal end of the vane 53 is referred to as a distal end 53A.

The vane 54 is an example of another vane. The vane 54 is located upstream from the vane 53 in the R direction. Further, when viewed in the X axis direction, the vane 54 extends, as an example, in the tangent direction to the virtual circle described above, forming an angle of 60 degrees between the extending direction of the vane 53 and the vane 54. In this configuration, the vane 54 is in contact with the medium bundle Q on the processing tray 32 (FIG. 1) when the vane 52 is at the retracted position. A distal end of the vane 54 is referred to as a distal end 54A.

A virtual circle drawn by the distal end 52A when the vane 52 rotates in the R direction is referred to as a rotation locus G. The shape of the rotation locus G is a circle about the rotation center C when viewed in the X axis direction and assuming that the lower guide member 34 is not present. In other words, the locus of the distal end 52A when the vane 52 moves without deforming corresponds to the rotation locus G. The rotation locus G, as an example, intersects a portion of the base 35 on the +Y side of the center in the Y axis direction. Further, in the present embodiment, the distal end 53A and the distal end 54A are also configured to move in the R direction along the rotation locus G.

The paddle driving unit 56 includes a motor and a gear (not shown), and the control unit 22 for controlling driving of the motor (FIG. 1). Further, the paddle driving unit 56 controls rotation of the shaft 48 so that the paddle member 46 stops at a predetermined position. As the paddle driving unit 56 controls rotation of the shaft 48 so that the vane 52, the vane 53, and the vane 54 come into contact with the medium P, the feeding section 36 feeds the medium P on the processing tray 32 toward the alignment member 62. Although not shown in the figure, the paddle member 46 is configured such that vane 52, the vane 53, and the vane 54, when not in use, stop at stop positions where they are not in contact with other members. For example, at a stop position, the distal end 52A is located on the +Z side of the lower guide member 34.

Notch

As shown in FIG. 5, the notch 38 is formed on the lower guide member 34 at a position inside the rotation locus G. Specifically, an upstream end of the notch 38 in the Y axis direction is formed at a position inside the rotation locus G. As shown in FIG. 4, the notch 38 is a portion formed on the +Y end of the lower guide member 34 and is cut out in the −Y direction, which is an upstream direction, that is, cut out toward upstream in the Y axis direction. Specifically, the notch 38 is formed at a portion that straddles part of the region SB and the entirety of the region SC and constitutes the +Y end of the lower guide member 34. In other words, the notch 38 is formed at a region through which the paddle member 46 passes in the X axis direction of the lower guide member 34. The shape of the notch 38 as viewed in the Z axis direction is, for example, a shape that is open to the +Y side. In addition, the shape of the inner space of the notch 38 is a rectangular shape which is longer in the X axis direction than in the Y axis direction as viewed in the Z axis direction.

Of a side wall constituting the −Y side peripheral edge of the notch 38, a surface on the +Y side is referred to as a side surface 39A. The position where the side surface 39A is located in the Y axis direction when viewed in the Z axis direction is referred to as a position Y1. The position Y1 is located, for example, on the −Y side of the position Y2 described above. In other words, the side surface 39A is offset on the −Y side from the end face 41 described above when viewed in the Z axis direction. The length of the side surface 39A in the X axis direction is referred to as L1 (mm). Further, the length of the vane 52 in the X axis direction is referred to as L3 (mm). The length L1 is longer than the length L3.

Of a side wall constituting the −X side peripheral edge of the notch 38, a surface on the +X side is referred to as a side surface 39B. The length of the side surface 39B in the Y axis direction is referred to as L2 (mm). The length L2 is determined in advance such that vibration of the vane 52 is mitigated at an early stage compared with the case where the vane 52 contacts the base 35 in the region SA. In other words, the length L2 is determined in advance such that deformation of the vane 52 caused by contact between the lower guide member 34 and the vane 52 is released at an early stage in rotation.

As shown in FIG. 5, when the paddle member 46 is viewed in the X axis direction, the first distance d1 (mm) from the rotation center C of the paddle member 46 to the notch 38 is smaller than the second distance d2 (mm) from the rotation center C to the processing tray 32. Specifically, the first distance d1, when viewed in the X axis direction, corresponds to the distance from the rotation center C to the center of the side surface 39A in the Z axis direction. The second distance d2, when viewed in the X axis direction, corresponds to the distance of a perpendicular line extending from the rotation center C to the upper surface 32A.

Transport Roller

The transport roller 68 shown in FIG. 3 is an example of a transport member. Further, the transport roller 68 includes a cylindrical shaft pin 68A, and a roller main body 68B having a tubular shape in which the shaft pin 68A is inserted. The shaft pin 68A has an axial direction in the X axis direction. The roller main body 68B has an outer diameter, in the state of being mounted on the side wall 42A and the side wall 42B, such that the outer circumferential surface of the roller main body 68B protrudes upward from the protrusion 37C and the protrusion 37D, respectively. Further, as an example, the width of the roller main body 68B in the X axis direction is larger than the width of the vane 52 in the X axis direction.

The −X end of the shaft pin 68A is inserted in the through hole formed in the side wall 42A and the +X end of the shaft pin 68A is inserted in the through hole formed in the side wall 42B such that the −X end and the +X end of the transport roller 68 are rotatably mounted on the side wall 42A and the side wall 42B, respectively. Two sets of the transport rollers 68 are provided at an interval in the X axis direction. The transport rollers 68 cooperate with the auxiliary roller 74 (FIG. 2) to hold the medium P therebetween, and rotates to thereby transport the medium P downstream on the +Y side.

Cleaning Member

A cleaning member 70 shown in FIG. 6 is an example of a cleaning unit. As described above, the cleaning member 70 is provided on the +Y end of the mounted surface 44. In the present embodiment, as an example, the cleaning member 70 is formed of a non-woven fabric cut into a rectangular shape which is longer in the X direction than in the Y direction. The cleaning member 70, which is bonded to the mounted surface 44 via an adhesive (not shown), is mounted on the lower guide member 34. The length L4 (mm) of the cleaning member 70 in the X axis direction is larger than the length L3 of the vane 52 in the X axis direction (FIG. 4).

The length of the cleaning member 70 in the Y axis direction and the thickness in the Z axis direction are determined in advance such that, even when the cleaning member 70 comes into contact with the vane 52, the vane 53, and the vane 54 plurality of times, the cleaning member 70 is prevented from being easily detached and vibration of the vane 52, the vane 53, and the vane 54 is reduced. The cleaning member 70, when being contacted by the paddle member 46, cleans the vane 52, the vane 53, and the vane 54 of the paddle member 46.

Processing Unit

The processing unit 60 shown in FIG. 2 includes the alignment member 62 as an alignment section, a stapler 64, a motor (not shown), and the control unit 22 (FIG. 1).

The alignment member 62 is, for example, made of a sheet metal member having an L-shape when viewed in the X axis direction, and is provided on the processing tray 32. Specifically, the alignment member 62 is positioned such that a bottom 62A is located on an extension line of the A axis direction of the upper surface 32A when viewed in the X direction. Further, the alignment member 62 aligns the -A side end (upstream end in the Y axis direction) of the medium bundle Q (FIG. 1) composed of the plurality of media P, which is supported and guided by the lower guide member 34. In other words, the alignment member 62 is configured to align the medium bundle Q so that the end of the plurality of media P on a side facing the stapler 64 is aligned in the B axis direction. Further, a pressing member 86 is provided on the +Z side, which is also the +A side of the alignment member 62, in a manner not to interfere with the paddle member 46. The pressing member 86 comes into contact with the +Z side of the medium bundle Q (FIG. 1) and presses the medium P to thereby prevent the medium bundle Q from being lifted up.

The stapler 64 is movable in the X axis direction when driven by a motor (not shown). Further, the stapler 64 is configured to perform edge binding processing of the aligned edge of the medium bundle Q when the operation of the stapler 64 is controlled by the control unit 22 (FIG. 1). Edge binding processing is an example of post-processing.

Description of Operation and Effect of Embodiment

As shown in FIG. 2, when the vane 52 is at the retracted position, the above-mentioned roller pair provided in the main transport path K1 (FIG. 1) transports the medium P onto the lower guide member 34. Then, the lower guide member 34 supports the medium P and guides the medium P in the +Y direction. The transport roller 68 and the auxiliary roller 74 cooperates with each other to transport the medium P toward the processing tray 32. Thus, the medium P is placed on the processing tray 32. As the auxiliary paddle 78 rotates, the medium P placed on the +Y side of the processing tray 32 is fed toward the -A side.

Figure 7:
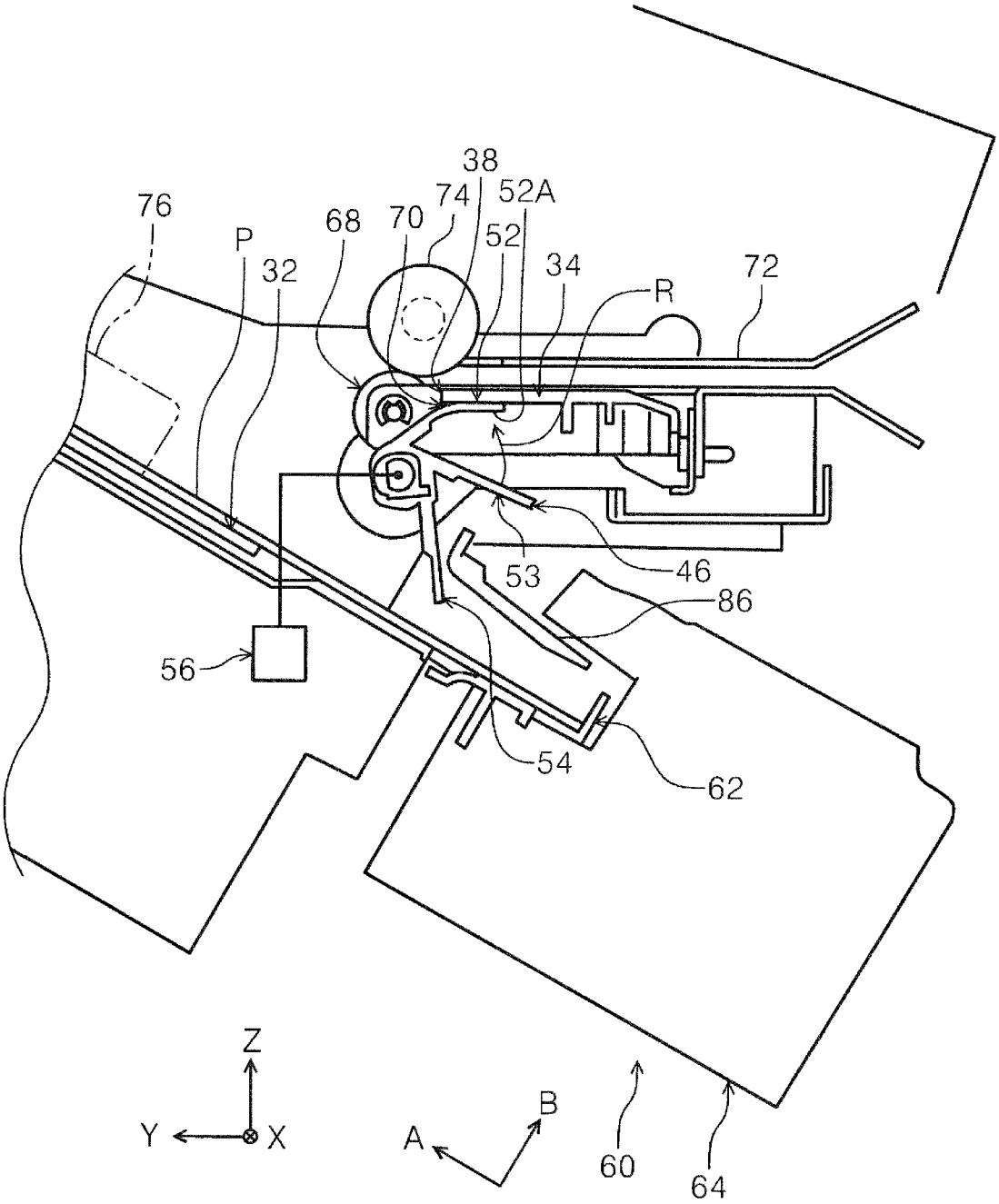
FIG. 7 is a schematic diagram illustrating part of an internal structure of the end unit.

Then, as shown in FIG. 7, the paddle member 46 rotates in the R direction when driven by the paddle driving unit 56. As the paddle member 46 rotates, the vane 52, the vane 53, and the vane 54 of the paddle member 46 sequentially contact with the lower guide member 34 in this order. As an example, the vane 52, the vane 53, and the vane 54 can achieve the same effect. The following description will be given of the vane 52, and the description of the vane 53 and the vane 54 may be omitted. When the vane 52 receives a reaction force at a portion from a center portion between the distal end and the proximal end to the distal end 52A due to contact with the lower guide member 34, the vane 52 is bent in a direction away from the R direction.

Subsequently, as the paddle member 46 rotates in the R direction, the distal end 52A of the vane 52 enters the notch 38 after a center portion passes through the notch 38. When the distal end 52A comes into contact with the cleaning member 70, the cleaning member 70 cleans a contact surface of the vane 52. As the cleaned vane 52 passes through the notch 38 and is released from the reaction force applied by the lower guide member 34, it returns to a flat plate due to the resilience. The vane 52 is released from the reaction force applied by lower guide member 34 at an early stage in rotation compared with the case of where no notch 38 is provided. In other words, since the vane 52 deforms to a smaller extent than the case where no notch 38 is provided, vibration of the vane 52 is reduced. As the paddle member 46 rotates, the vane 52, which has returned to the flat plate, comes into contact with the medium P on the processing tray 32 to thereby feed the medium P toward the alignment member 62.

Figure 8:
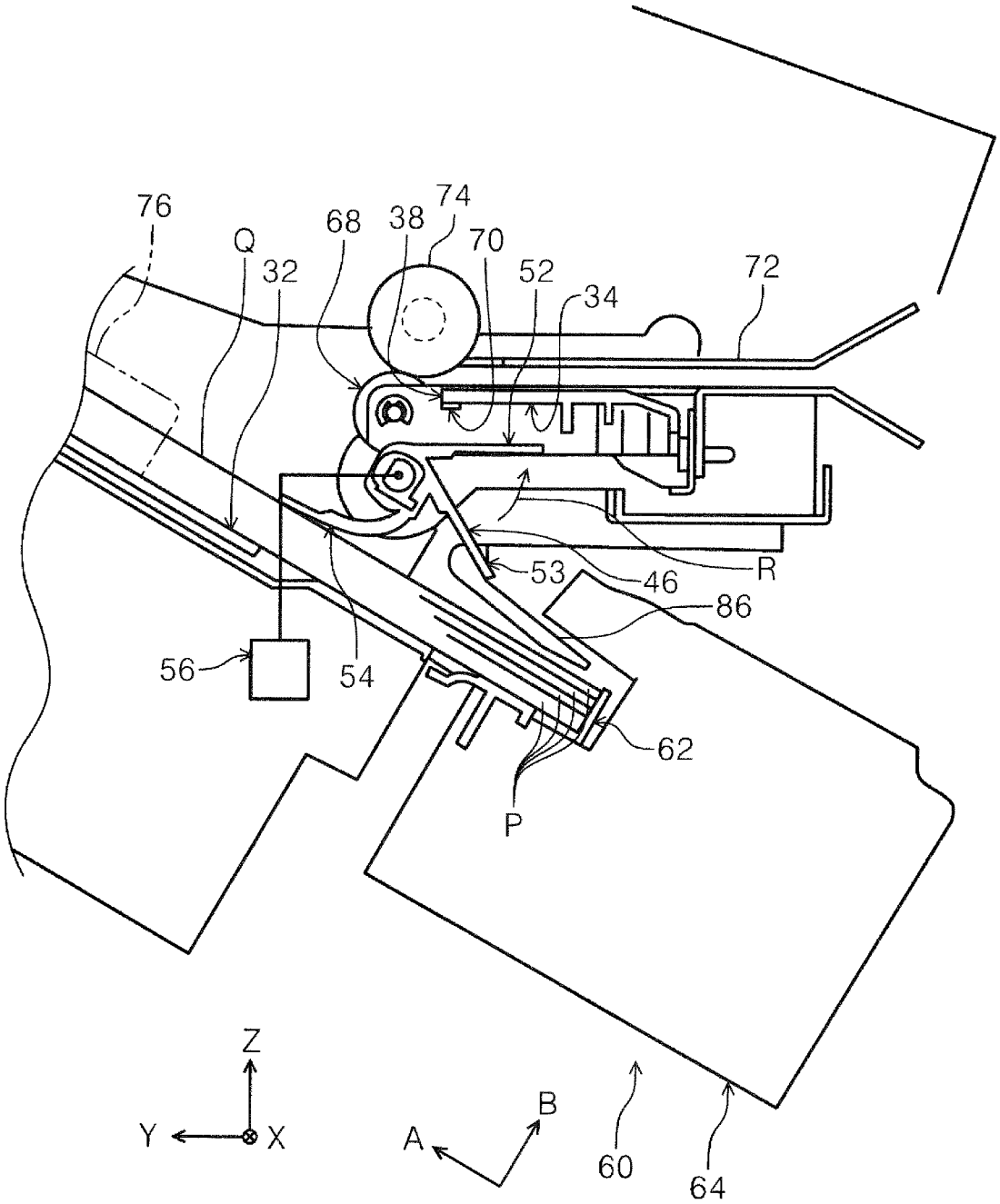
FIG. 8 is a schematic diagram illustrating part of an internal structure of the end unit.

As shown in FIG. 8, while the plurality of media P are stacked on the processing tray 32, the side cursor 76 aligns the plurality of media P in the X axis direction to form the medium bundle Q. As the paddle member 46 rotates in the R direction, the vane 52, the vane 53, and the vane 54 feed the medium bundle Q toward the alignment member 62. The alignment member 62 aligns the -A end of the medium bundle Q. The stapler 64 performs edge binding processing of the medium bundle Q. After the edge binding processing, the medium Q is outputted onto the output tray 26 (FIG. 2) by the feed-out roller pair 82 (FIG. 2). Thus, post-processing of the medium P is performed.

(1) In summary of the above description, according to the present embodiment, the lower guide member 34 supports the medium P transported in the Y direction, and guides the medium P toward a second end of the processing tray 32 in the Y axis direction. The processing tray 32 accommodates the media P that have been guided by the lower guide member 34 so that the media P are stacked as the medium bundle Q. The paddle member 46 rotates to thereby feed the medium P placed on the processing tray 32 toward the alignment member 62. The alignment member 62 aligns the first end of the medium bundle Q in the Y axis direction. Since a portion of the lower guide member 34 other than the notch 38 supports the medium P from the −Z side while the medium P is transported in the Y axis direction, the medium P can be guided downstream in the Y axis direction in a stable manner.

When the distal ends 52A, 52B, and 52C come into contact with the lower guide member 34 as the paddle member 46 rotates, a portion of the lower guide member 34 where the notch 38 is formed allows the distal ends 52A, 52B, and 52C to enter and pass through the notch 38 in the R direction. Accordingly, the distal ends 52A, 52B, and 52C and the lower guide member 34 are disengaged from each other at an early stage in the rotation. As a result, vibration of the paddle member 46 caused by contact between the paddle member 46 and the lower guide member 34 is reduced, which prevents the vibration from being propagated to the medium P when the paddle member 46 feeds the medium P. Accordingly, the medium P can be fed to the alignment member 62 in a stable manner. That is, in a configuration in which the paddle member 46 interferes a guide path along which the medium P is guided by the lower guide member 34, the medium P can be stably transported to the processing tray 32 and stably fed to the alignment member 62. Further, in the present embodiment, since vibration of the paddle member 46 is reduced, it is possible to reduce variation in relative speed between the feeding speed of the medium P fed by the auxiliary paddle 78 and the feeding speed of the medium P fed by the paddle member 46. Accordingly, the medium P can be further stable fed to the alignment member 62.

(2) According to the present embodiment, when the paddle member 46 rotates, a portion of the paddle member 46 including the distal ends 52A, 52B, and 52C comes into contact with the cleaning member 70. The portion of the paddle member 46 is cleaned by the cleaning member 70. Accordingly, even if dirt is attached on part of the paddle member 46 during previous feeding operation for the medium P, the dirt is cleaned by the cleaning member 70 so that the medium bundle Q is prevented from getting dirty in the next feeding operation.

(3) According to the present embodiment, the processing tray 32 and the lower guide member 34 can be disposed close to each other compared with a configuration in which the first distance d1 is larger than the second distance d2. Accordingly, the medium transport unit 30 can be reduced in size.

(4) According to the present embodiment, the transport roller 68 is rotatably mounted on the side wall 42A, which is a side wall on a first end of the notch 38 in the X axis direction. As the transport roller 68 rotates, frictional force applied to the medium P decreases, which facilitates transport of the medium P. In addition, since the side wall 42A is adjacent to a notched space, an operation of mounting the transport roller 68 to the side wall 42A can be easy. That is, it is possible to facilitate transport of the medium P, and facilitate operation of mounting the transport roller 68 to the side wall 42A.

(5) According to the present embodiment, when the medium P is guided by the lower guide member 34, the vane 52 is at the retracted position on a side of the lower guide member 34 to the medium P. Accordingly, while the paddle member 46 is stationary, the vane 52 does not protrude from the lower guide member 34 into the transport path of the medium P. Therefore, the vane 52 and the medium P can be prevented from being in contact with each other. Furthermore, when the retracted position is set as a position spaced from the lower guide member 34, the vane 52 does not contact with the lower guide member 34. Since the vane 52 is not exposed to a load, the possibility of deformation of the vane 52 can be reduced. That is, it is possible to prevent the vane 52 from interfering with the transport of the medium P, and prevent the vane 52 from deforming.

(6) According to the present embodiment, since the vane 52 is at the retracted position, it is possible to prevent the vane 52 from interfering with the transport of the medium P. Further, since the vane 54 is in contact with the medium bundle Q on the processing tray 32 when the vane 52 is at the retracted position, it is possible to prevent the medium bundle Q on the processing tray 32 from being displaced. That is, it is possible to prevent the vane 52 from interfering with the transport of the medium P, and prevent the medium bundle Q from being displaced.

According to the present embodiment, while the vibration of the paddle member 46 is reduced by the notch 38, the vanes 52, 53, and 54 of the paddle member 46 is configured to contact the lower guide member 34. As the vanes 52, 53, and 54 come into contact with the lower guide member 34, the vanes 52, 53, and 54 deform, which decreases an apparent turning radius of the vanes 52, 53, and 54. Accordingly, the auxiliary roller 74 can be positioned, for example, close to the paddle member 46. Therefore, the medium transport unit 30, the post-processing unit 3, and the recording system 1 can be reduced in size in the Z direction.

Other Embodiments

Although the medium transport unit 30, the post-processing unit 3, and the recording system 1 according to the embodiment of the present disclosure basically have the configuration described above, it is possible to partially modify or omit the configuration without departing from the gist of the invention.

The recording system 1 is not limited to the ink jet type, and may also be of an electrophotographic type. The post-processing performed by the post-processing unit 3 is not limited to the edge binding processing using a stapler. Other processing such as punching for punching out the media P, folding for folding the media P, saddle-stitch binding for binding the media P by saddle-stitching, and the like may also be applied.

The cleaning member 70 may not necessarily be provided on the mounted surface 44. The first distance d1 may be larger than the second distance d2. The transport roller 68 may not necessarily be mounted on the side wall 42A of the lower guide member 34. The transport roller 68 may not necessarily be provided on the lower guide member 34. The vane 52 may be in contact with the lower guide member 34 when the medium P is guided. When the vane 52 is at the retracted position, the vane 54 may not be in contact with the medium bundle Q on the processing tray 32.

The notch 38 may have a U-shape or an arc shape as viewed in the Z direction. Further, the notch 38 may have the size and shape that cause the vanes 52, 53, and 54 not to be in contact with the lower guide member 34. In other words, the notch 38 may be formed in the lower guide member 34 at a position including the rotation locus G.

The cleaning member 70 may also be a brush. Alternatively, the cleaning member 70 may be an elastic member with a corrugated surface like a washing board. The cleaning member 70 may also be an adhesive member that absorbs dirt. The cleaning member 70 may also be a sheet-like member that absorbs paper dust. The cleaning member 70 may also be a member having an edge shape for scraping dirt. In addition, a configuration for removing dirt by electrostatic adsorption may be used as another example of the cleaning unit.

The auxiliary paddle 78 may not necessarily be provided in the post-processing unit 3. The medium transport unit 30, the post-processing unit 3, and the recording system 1 are not limited to the center registration type in which the media P are transported while being center-registered in the width direction, and a side registration type in which the media P are transported while being side-registered in the width direction may also be used.

The lower guide member 34 is not limited to one having four regions PA, PB, PC, and PD on one side about the center in the X axis direction, and the number of regions may be other than four.

The paddle member 46 is not limited to one having three vanes 52, 53, and 54, and the number of vanes may be other than three. Further, extending direction of the vane of the paddle member 46 is not limited to the tangent direction, and the vane may extend radially from the rotation center.

What is claimed is:

1. A medium transport device comprising:

a guide member that supports and guides a medium transported in a transport direction;

a stacking section having an alignment section that aligns upstream end in the transport direction of a medium bundle composed of a plurality of media supported and guided by the guide member, the stacking section being configured so that a plurality of the media are stacked thereon;

a feeding section having a feeding member formed of an elastic material, and the feeding section being configured to rotate to feed the medium on the stacking section toward the alignment section; and a notch formed in the guide member at a region where the feeding member is disposed in a width direction of the guide member which intersects the transport direction, the notch being cut out toward upstream in the transport direction, wherein a rotation center of the feeding section is disposed at a position between the stacking section and the guide member such that a rotation locus of a distal end of the feeding member intersects the guide member when viewed in the width direction, an upstream end of the notch in the transport direction is formed inside the rotation locus, and a transport member that transports the medium is rotatably provided on a side wall of the notch of the guide member on one side in the width direction.

2. The medium transport device according to claim 1, wherein a cleaning unit that cleans the feeding member by contacting the feeding member is provided on the guide member at a position upstream from the notch in the transport direction on a surface opposite to that supporting the medium.

3. The medium transport device according to claim 1, wherein a first distance from the rotation center of the feeding member to the notch is smaller than a second distance from the rotation center to the stacking section when the feeding member is viewed in the width direction.

4. The medium transport device according to claim 1, wherein the feeding member includes a shaft rotatable about an axial direction in the width direction, and at least one vane extending outward from the shaft, and the vane is positioned at a retracted position on an opposite side of the guide member to the medium when the medium is guided by the guide member.

5. The medium transport device according to claim 4, wherein the feeding member includes a plurality of vanes provided at an interval in a rotation direction, and, when a first vane among the plurality of vanes is located at the retracted position, another vane is in contact with the medium bundle in the stacking section.

6. A post-processing device comprising:

the medium transport device according to claim 1; and a processing unit configured to perform post-processing to a medium transported by the medium transport device.

7. A recording apparatus comprising:

a recording unit configured to record on a medium; and the post-processing device according to claim 6, the post-processing device being configured to perform post-processing to the medium that recorded by the recording unit.

8. A medium transport device comprising:

a guide member that supports and guides a medium transported in a transport direction;

a stacking section having an alignment section that aligns upstream end in the transport direction of a medium bundle composed of a plurality of media supported and guided by the guide member, the stacking section being configured so that a plurality of the media are stacked thereon;

a feeding section having a feeding member formed of an elastic material, and the feeding section being configured to rotate to feed the medium on the stacking section toward the alignment section; and a notch formed in the guide member at a region where the feeding member is disposed in a width direction of the guide member which intersects the transport direction, the notch being cut out toward upstream in the transport direction, wherein a rotation center of the feeding section is disposed at a position between the stacking section and the guide member such that a rotation locus of a distal end of the feeding member intersects the guide member when viewed in the width direction, an upstream end of the notch in the transport direction is formed inside the rotation locus, and a cleaning unit that cleans the feeding member by contacting the feeding member is provided on the guide member at a position upstream from the notch in the transport direction on a surface opposite to that supporting the medium.

9. The medium transport device according to claim 8, wherein a first distance from the rotation center of the feeding member to the notch is smaller than a second distance from the rotation center to the stacking section when the feeding member is viewed in the width direction.

10. The medium transport device according to claim 8, wherein the feeding member includes a shaft rotatable about an axial direction in the width direction, and at least one vane extending outward from the shaft, and the vane is positioned at a retracted position on an opposite side of the guide member to the medium when the medium is guided by the guide member.

11. The medium transport device according to claim 10, wherein the feeding member includes a plurality of vanes provided at an interval in a rotation direction, and, when a first vane among the plurality of vanes is located at the retracted position, another vane is in contact with the medium bundle in the stacking section.

12. A post-processing device comprising:

the medium transport device according to claim 8; and a processing unit configured to perform post-processing to a medium transported by the medium transport device.

13. A recording apparatus comprising:

a recording unit configured to record on a medium; and the post-processing device according to claim 12, the post-processing device being configured to perform post-processing to the medium that recorded by the recording unit.

14. A medium transport device comprising:

a guide member that supports and guides a medium transported in a transport direction;

a stacking section having an alignment section that aligns upstream end in the transport direction of a medium bundle composed of a plurality of media supported and guided by the guide member, the stacking section being configured so that a plurality of the media are stacked thereon;

a feeding section having a feeding member formed of an elastic material, and the feeding section being configured to rotate to feed the medium on the stacking section toward the alignment section, wherein the feeding member includes a shaft rotatable about an axial direction in the width direction, and at least one vane extending outward from the shaft, and the vane is positioned at a retracted position on an opposite side of the guide member to the medium when the medium is guided by the guide member; and a notch formed in the guide member at a region where the feeding member is disposed in a width direction of the guide member which intersects the transport direction, the notch being cut out toward upstream in the transport direction, wherein a rotation center of the feeding section is disposed at a position between the stacking section and the guide member such that a rotation locus of a distal end of the feeding member intersects the guide member when viewed in the width direction, an upstream end of the notch in the transport direction is formed inside the rotation locus, and the notch formed in the guide member penetrates the guide member from a bottom side to a top side such that a portion of the feeding member is able to pass through the guide member.

15. The medium transport device according to claim 14, wherein a first distance from the rotation center of the feeding member to the notch is smaller than a second distance from the rotation center to the stacking section when the feeding member is viewed in the width direction.

16. The medium transport device according to claim 14, wherein the feeding member includes a plurality of vanes provided at an interval in a rotation direction, and, when a first vane among the plurality of vanes is located at the retracted position, another vane is in contact with the medium bundle in the stacking section.

17. A post-processing device comprising:

the medium transport device according to claim 14; and a processing unit configured to perform post-processing to a medium transported by the medium transport device.

18. A recording apparatus comprising:

a recording unit configured to record on a medium; and the post-processing device according to claim 17, the post-processing device being configured to perform post-processing to the medium that recorded by the recording unit.

* * * * *